US007119758B2

(12) United States Patent
Louzir et al.

(10) Patent No.: US 7,119,758 B2
(45) Date of Patent: Oct. 10, 2006

(54) HIGH FREQUENCY, MULTIPLE BEAM ANTENNA SYSTEM

(75) Inventors: Ali Louzir, Rennes (FR); Jean-Francois Pintos, Bourgbarre (FR); Philippe Chambelin, Chateaugiron (FR); Florent Averty, Rennes (FR)

(73) Assignee: Thomson Licensing, Boulogne-Billancourt (FR)

( * ) Notice: Subject to any disclaimer, the term of this patent is extended or adjusted under 35 U.S.C. 154(b) by 53 days.

(21) Appl. No.: 10/977,026

(22) Filed: Oct. 29, 2004

(65) Prior Publication Data

US 2005/0122276 A1 Jun. 9, 2005

(30) Foreign Application Priority Data

Oct. 31, 2003 (FR) ..... 03 50765

(51) Int. Cl.
*H01Q 15/08* (2006.01)

(52) U.S. Cl. ..... 343/911 R; 434/753; 434/911 L; 434/770

(58) Field of Classification Search ..... 343/753, 343/911 L, 911 R, 702, 767, 770
See application file for complete search history.

(56) References Cited

U.S. PATENT DOCUMENTS 2,887,684 A * 5/1959 Dexter et al. ..... 343/781 R
3,795,002 A 2/1974 Nemit
4,315,281 A * 2/1982 Fajans ..... 348/42
4,531,129 A * 7/1985 Bonebright et al. ..... 343/754
5,859,615 A * 1/1999 Toland et al. ..... 343/753
2002/0164951 A1 11/2002 Slaughter et al.

FOREIGN PATENT DOCUMENTS

GB 688374 3/1953

OTHER PUBLICATIONS

Search Report.

Stockbroeckx B "Microwave antennas at UCL: a design point of view" Soc. Blege Ing. Telecommun. & Electron/IEE No. 1, 2002, pp. 11-21, XP009031528 Louvian-la-Neuve, Belgium ISSN: 0035-3248.

* cited by examiner

*Primary Examiner*—Tan Ho
(74) *Attorney, Agent, or Firm*—Joseph J. Laks; Robert D. Shedd; Brian J. Cromarty

(57) ABSTRACT

The high frequency, multiple beam antenna system comprises a focusing device having a profile of revolution created by the cross section of a dielectric lens rotating about an axis located in its plane and radiating elements with form of directional-printed antennas with longitudinal radiation.

10 Claims, 3 Drawing Sheets

HIGH FREQUENCY, MULTIPLE BEAM ANTENNA SYSTEM

This application claims the benefit, under 35 U.S.C. 119, of France patent application No. 0350765 filed Oct. 31, 2003.

The present invention relates to a high-frequency, multiple beam antenna system. More specifically, the invention relates to a high gain millimetric antenna with multiple radiating elements (or primary sources) that illuminate a focusing device to radiate 360° in azimuth.

BACKGROUND OF THE INVENTION

The invention is intended more specifically for a high bit rate wireless communication network using the LMDS (Local Multipoint Distribution Service) system, which is based on a cellular architecture. In this architecture, a sending/receiving station equipped with antennas to be able to communicate with the other stations of the cell, can serve as a node of the cell. In this case, the architecture is called "P-MP" (Point-MultiPoint). Another possible architecture for this system is the "MP—MP" (MultiPoint-MultiPoint) architecture, in which each station can be a relay in a call between two other stations of the wireless network.

The millimetric frequencies (30 to 3000 GHz) or EHF (Extra High Frequencies) are used with a view to increasing the information transfer rates in the wireless networks. At such frequencies, the available bandwidths are wide (greater than 1 GHz) but the attenuation as a function of distance is high.

The coverage rate is therefore limited by the short range of the millimetric frequency transmit stations that make up such a wireless network, and by the need to have an "LOS" (Line Of Sight) between a sending station and a receiving station of the network. Despite the low cost and the performance of the LMDS systems at millimetric frequencies, their coverage limitations mean that they cannot be deployed intensively.

In an MP—MP architecture, or mesh network architecture, in which each station of the network can be a relay station, the obstacles can be circumvented. Thus, the coverage and the capacity of the high bit rate wireless network are improved.

The attenuation as a function of distance limiting the transmission range between two stations of the high bit rate wireless network is offset by a high antenna gain. Increasing the gain of an antenna involves improving its directivity and therefore concentrating its radiation pattern in a precise direction. Consequently, the alignment of the antenna must also be accurate.

Furthermore, changing the configuration of the network must involve a reliable realignment of the antenna system of the stations of the network with a 360° coverage in azimuth for each station.

A solution proposed by the Radiant Networks company is an antenna system made up of four high gain millimetric antennas. The system uses an access technique known as "TDMA/TDD" (Time Division Multiple Access, Time Division Duplex). In this technique, the time is divided into frames of a fixed duration, which are in turn subdivided into "slots". The slots are used individually for sending/receiving between two antennas aligned for a call between their respective stations. The antennas are aligned mechanically through the intermediary of a motor. This solution is complex, expensive and bulky. Furthermore, the mechanical alignment is neither reliable nor instantaneous.

Another solution is described in patent application GB2238174A. This document describes a high-frequency antenna made up of a set of dielectric lenses adjacent to one another and arranged to obtain 360° coverage in azimuth. The rear surface of each lens is itself made up of several radiating elements for sending and receiving. These elements are precisely arranged to send or receive beams according to different, evenly spaced angular directions, the periodicity of which is maintained from one lens to the next. The lenses are delimited on each side by a flat surface, the direction of which passes through the central axis of symmetry of the optical system. This antenna system is complicated to implement. In this system, a number of radiating elements are used for the same lens. The result is, necessarily, that certain of these radiating elements are out of focus. The antenna system does not present the same radiation pattern, and in particular the same directivity, in all the directions corresponding to the feeds.

BRIEF SUMMARY OF THE INVENTION

The invention proposes a simpler millimetric antenna system, which satisfies the requirements of a network using a mesh network architecture and which rectifies the drawbacks described above.

In particular, the invention proposes a millimetric antenna system having a 360° coverage in azimuth and a high gain and which is inexpensive.

To this end, the invention relates to a high-frequency antenna system as described above, this antenna system comprises a focusing device having a profile of revolution created by the cross section of a dielectric lens rotating about an axis located in its plane and radiating elements in the form of directional printed antennas with longitudinal radiation.

The dielectric lens can be axisymmetric, for example with a crescent-shaped cross section or with a circular, monofocal, bifocal, multifocal cross section, with perfect or imperfect focusing, etc.

An antenna system according to the invention can offer the following particular characteristics:

- the radiating elements are printed on a common substrate.
- each radiating element is a "Vivaldi" type printed slot antenna which means that the illumination of the antenna system can be adjusted with high design flexibility by adjusting the length and width at the end of the slot forming the "Vivaldi" type radiating element.
- it is equipped with transmit and/or receive and/or switching circuits arranged on said common substrate.
- the focusing device has an annular profile of revolution, the substrate is disc-shaped and the radiating elements are arranged along the periphery of the substrate to obtain a 360° coverage in azimuth.
- the radiating elements are arranged around transmit and/or receive and/or switching circuits which helps to reduce the bulk of the antenna system.
- the focusing device is made of synthetic foam.

The invention is extended to a sending and/or receiving station with an antenna system as defined above, and to a communication network with sending/receiving stations equipped with an antenna system according to the invention.

BRIEF DESCRIPTION OF THE DRAWINGS

The invention is now described in greater detail and illustrated by the drawings.

DESCRIPTION OF PREFERRED EMBODIMENTS

Generally, a focusing device for a millimetric antenna system according to the invention takes the form of a kind of "buoy" with annular profile of revolution and constant radial section.

Figure 1:
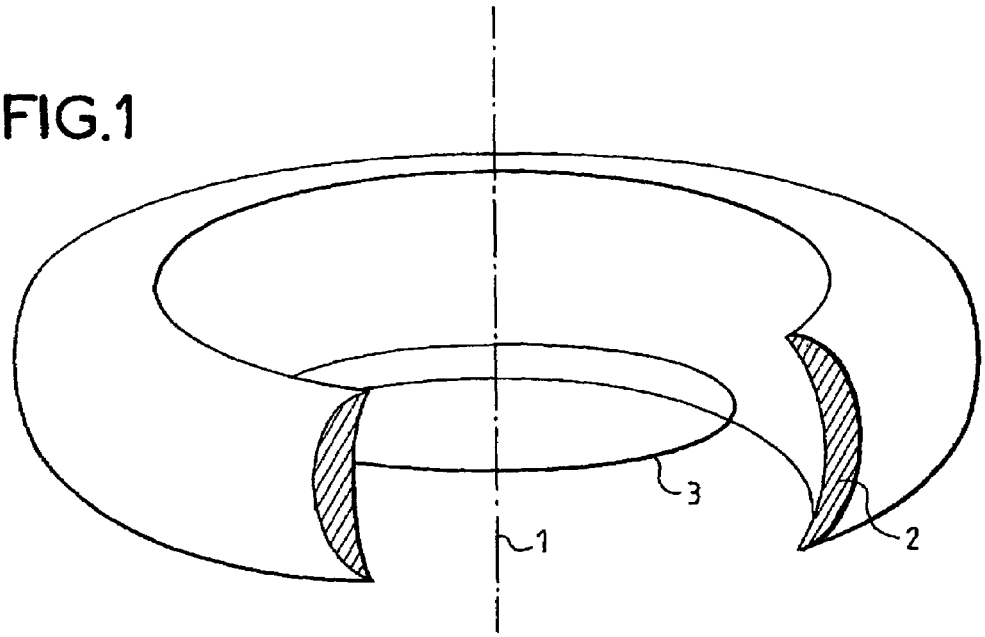
FIG. 1 shows very schematically a first example of an antenna system according to the invention.

FIG. 1 represents a first exemplary embodiment of a focusing device having a profile of revolution created by the crescent-shaped cross section of a dielectric lens 2 rotating about an axis 1 located in its plane. In this example, the focusing area comprising all the focal points is circumscribed on a circle 3. The focus is therefore perfect.

Figure 2:
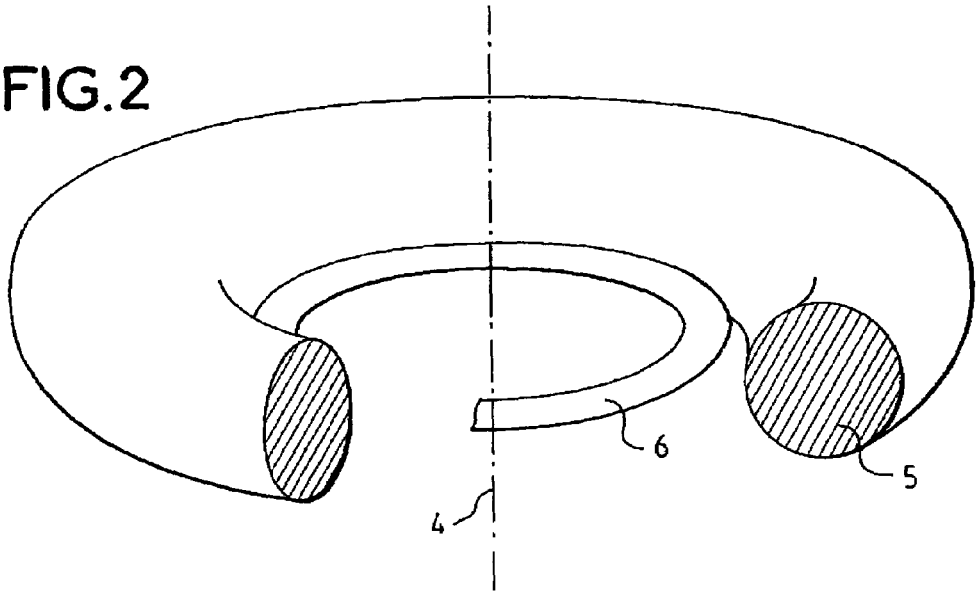
FIG. 2 shows very schematically a second example of an antenna system according to the invention.

FIG. 2 shows another example of a focusing device according to the invention. This focusing device has a profile of revolution created by the circular-shaped cross section of a dielectric lens 5 rotating about an axis 4 located in its plane. In this example, the focusing area comprising all the focal points is circumscribed in a ring 6. The focus is therefore imperfect.

Naturally, the invention is extended to a focusing device with a different profile of revolution, which can be obtained from a cross section of a lens, that is neither circular nor "crescent"-shaped.

Figure 3:
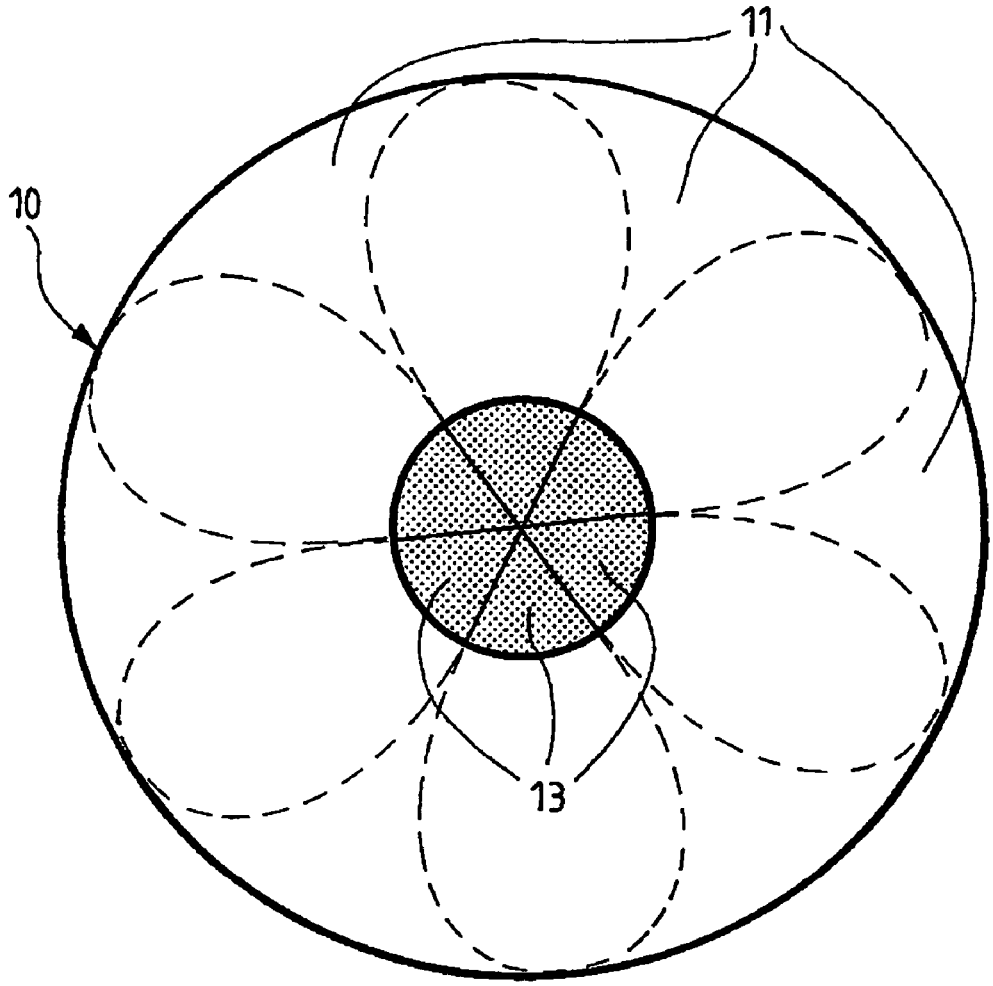
FIG. 3 shows very schematically the arrangement of the radiating elements and of the switching and transmit/receive circuits on a common substrate.

FIG. 3 very schematically illustrates a printed circuit substrate 10 on which are printed Vivaldi antenna type radiating elements 11 and switching and transmit/receive circuits 13. This disc-shaped substrate is placed at the centre and in the horizontal plane of symmetry of a focusing device such as, for example, that illustrated in FIG. 1 or 2.

As can be seen in FIG. 3, the Vivaldi antennas 11 are distributed in a circle around the periphery of the substrate to provide a 360° coverage in azimuth. The phase centre of each Vivaldi antenna should coincide with a focal point of the focusing area 3 or 6.

Furthermore, the Vivaldi antennas are directional slot antennas with longitudinal radiation. In the case of the invention, the main direction of their radiation corresponds to the plane of the substrate 10. This type of antenna provides for relatively easy control of the focusing device (in this case, the buoy), by an adjustment of the length, the profile and the width at the "mouth" of the "Vivaldi" antenna. The illumination control of the focusing system is used to control the radiation pattern and in particular the directivity of the antenna system.

As described above, the reference 13 designates transmit/receive circuits and a switching device, the latter selecting the radiating element corresponding to the given azimuth direction. As can be seen in FIG. 3, the antennas 11 are arranged around the circuits 13 which are thus concentrated at the centre of the substrate 10. At the centre of the substrate, it is also possible to print signal processing circuits.

Combining all these elements 11 and 13 on a same common substrate simplifies the antenna system and makes it less bulky.

Figure 4:
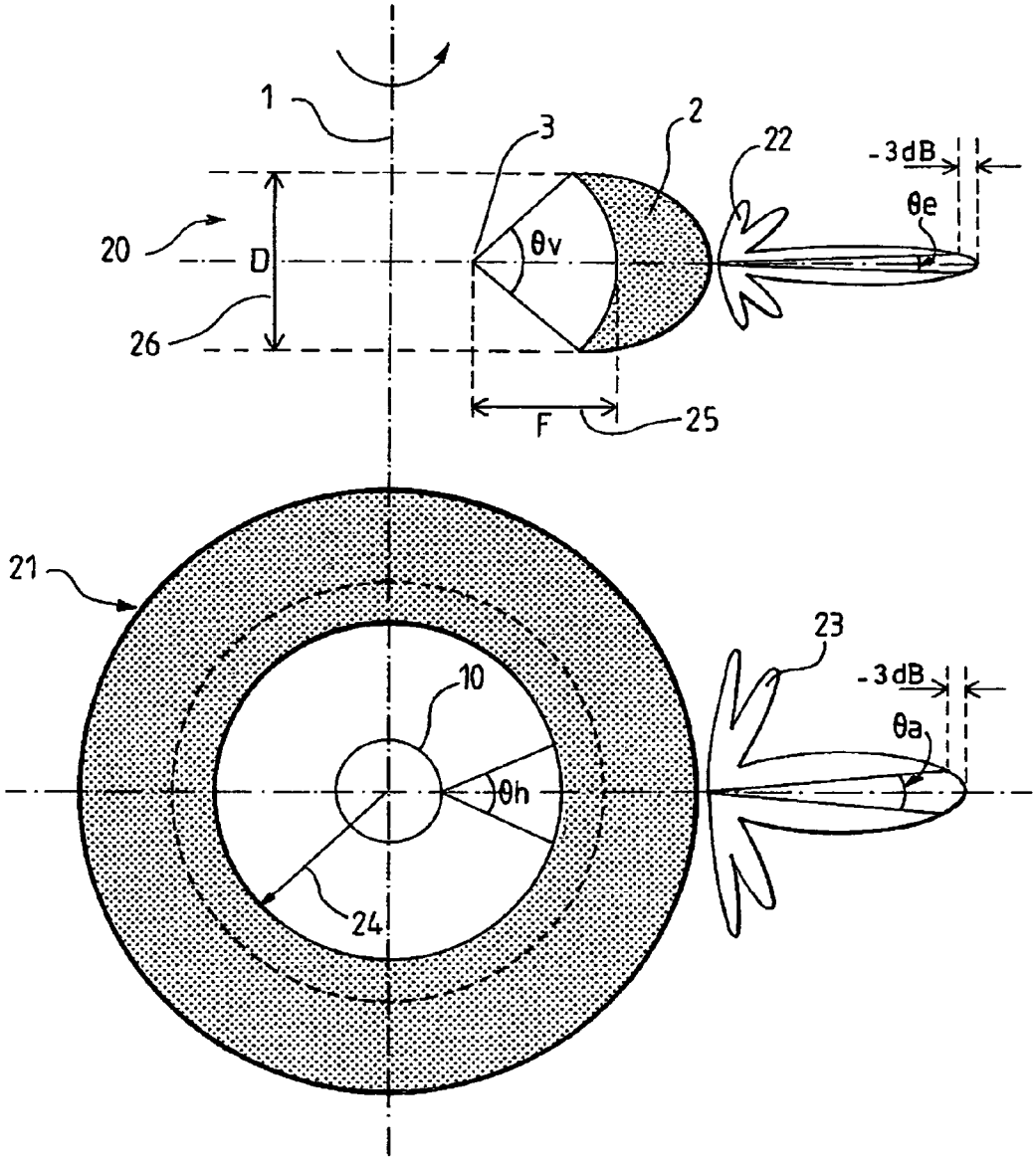
FIG. 4 illustrates the radiation pattern of the focusing device of an antenna system according to the invention.

FIG. 4 illustrates the radiation pattern of an antenna system according to the invention in the vertical plane 20 and in the horizontal plane 21.

The radiation pattern is obtained by illuminating a portion of the buoy-shaped focusing device via a radiating element 11.

It can be seen that in the vertical plane 20, the directivity of the radiation pattern 22 obtained is the same as that obtained from a axisymmetric lens. In FIG. 4, θe designates the aperture angle of the antenna in elevation at −3 dB.

Conversely, in the horizontal plane 21, the directivity of the radiation pattern 23 obtained is less than that obtained from a lens of revolution in the case of identical illumination in azimuth by a radiating element. It is known that, in the case of a lens of revolution, the illumination by a radiating element having a pattern of revolution can be used to obtain an equivalent radiating aperture virtually uniform in phase and in amplitude. In the case of the antenna system according to the invention, the focusing device, by its tubular shape, introduces phase and amplitude distortions resulting in a loss of directivity. In FIG. 4, θa designates the azimuth aperture at −3 dB.

The use of a Vivaldi type slot antenna according to the invention provides for a control of the length, of the profile and of the aperture of the slot at the "mouth" 11. A narrower aperture provides illumination of a greater portion in azimuth of the focusing device (greater angle ThetaV). The gain and therefore the directivity of the antenna in azimuth are increased, since the illuminated area is greater. However, illuminating a wider portion in azimuth of the focusing device also causes greater phase distortions. A maximum directivity in azimuth is obtained by optimization, by adjusting the radius 24 of the focusing device and the directivity of the Vivaldi antenna in the horizontal plane.

The antenna system according to the invention is configured as follows:

- the focal distance 25 (F) is determined by the shape of the cross section of the focusing device, the permittivity of the supposedly homogeneous material, and the height 26 (D) of the radial section of the focusing device according to the axis of rotation such as 1 or 4.
- the radius 24 of the focusing device must be greater than the focal distance 25. It can be increased to have a greater space available at the centre of the focusing device so that the substrate 10 can contain not only the Vivaldi antennas but also the excitation system including the transmit/receive circuits and the switching device 13.
- the parameters of the radiating element: θv vertical aperture angle at −3 dB and θh horizontal aperture angle at −3 dB.

An estimation of the gain G of the antenna is given by the relation:

G (in dB)=10 log (K/θe θa) (1) in which K is a constant with a value of between approximately 26000 and 35000 inclusive according to the illumination efficiency of the antenna.

The antenna gain must be sufficient to offset the attenuation as a function of distance and thus be compatible with the requirements of a high bit rate wireless network.

An approximate value of the aperture angle in elevation at −3 dB is given by the following relation:

$$\Theta e = k\lambda / D \qquad (2)$$

in which

λ designates the wavelength of the working frequency

D designates the height of the radial section of the focusing device k is a constant typically varying between 60 and 80 according to the illumination efficiency of the antenna In a first approximation, θa can be taken to be equal to θh.

It is always possible to increase the value of the antenna gain by increasing the height 26 (D). The number N of radiating elements needed to obtain a 360° azimuth coverage and for a gain value greater than Gmin=G−3 dB is given by the following relation:

$$N=360°/\theta a \quad (3)$$

An antenna system according to the invention has been produced and the focusing device presents the following characteristics:

homogeneous lens, circular inner profile, elliptical outer profile, the synthetic foam used for the focusing device is typically polystyrene prefilled with dielectric material, the material has a permittivity $\epsilon r<2$, preferably a permittivity equal to 1.56, height D of 11.5 cm, frequency 42 GHz, An aperture angle in elevation is obtained which is derived from the relation (2) Θe=4° (for k approximately equal to 65).

The radiating element 11 has an aperture angle of 28° at −3 dB to the horizontal (θh) and to the vertical (θv). If in a first approximation, it is assumed that θa equals θh, the number N of radiating elements needed to have a 360° azimuth coverage which is given by the relation (3) is equal to $$N=360/28=13.$$

With this antenna system construction, an antenna gain is obtained which is:

1. G=23.6 dB for K=26000
2. G=24.9 dB for K=35000 taking into account the 3 dB of losses at the edge of the beam, the minimum gain for the antenna system is between 20.6 and 21.9 dB inclusive.

In the example described above of an antenna system according to the invention, Vivaldi slot antenna dimensions have been calculated to provide, for the antenna system, a minimum gain of between 20.6 and 21.9 dB inclusive, where the length of the profile of the slot must be 26 mm and the aperture 9 mm.

The thirteen Vivaldi antennas are distributed in a circle along the focusing area of the disc-shaped substrate 10 which has a diameter of approximately 8 cm with a 25 mm diameter space in the centre containing the switching circuits and the transmit/receive circuits 13. If necessary, the diameter of the disc 10 can be increased to provide more space in the centre to contain the rest of the antenna circuits.

The focusing device according to the invention can also have a profile obtained from a cross section of a non-homogeneous dielectric lens, with graded index for example.

The invention can also be applied to interior domestic communication networks in particular at 60 GHz with a mesh network architecture.

In an antenna system according to the invention, the radiating elements have a horizontal polarization as in the case of the Vivaldi antennas. As a general rule, these radiating elements are planar coplanar radiating elements arranged on a substrate extending in the horizontal plane of symmetry of the buoy-shaped focusing device. In the case of a double polarization or a vertical polarization, horns can be used as the radiating elements.

What is claimed is:

1. High frequency, multiple beam antenna system, comprising a focusing device having a profile of revolution created by the cross section of a dielectric lens rotating about an axis located in its plane, wherein it comprises radiating elements in the form of directional printed antennas with longitudinal radiation.

2. Antenna system according to claim 1, in which the radiating elements are printed on a common substrate.

3. Antenna system according to claim 1, in which each radiating element is a "Vivaldi" type printed slot antenna.

4. Antenna system according to claim 2, further comprising transmit and/or receive and/or switching circuits arranged on said common substrate.

5. Antenna system according to claim 4, in which the focusing device has an annular profile of revolution, in which the substrate is disc-shaped and in which the radiating elements are arranged along the periphery of the substrate.

6. Antenna system according to claim 5, in which the radiating elements are arranged around transmit and/or receive and/or switching circuits.

7. Antenna system according to claim 1, in which the focusing device is made of synthetic foam and has a circular radial section.

8. Antenna system according to claim 1, in which the focusing device is made of synthetic foam and has a crescent-shaped radial section.

9. Sending/receiving station for a mesh-network-architecture wireless communication network, including an antenna system comprising a focusing device having a profile of revolution created by the cross section of a dielectric lens rotating about an axis located in its plane, wherein it comprises radiating elements in the form of directional printed antennas with longitudinal radiation.

10. Mesh-network-architecture wireless communication network, wherein it comprises at least one or more sending/receiving stations according to claim 9.

* * * * *